US009732569B2

(12) United States Patent
Loevsland

(10) Patent No.: US 9,732,569 B2
(45) Date of Patent: Aug. 15, 2017

(54) LIFTING ARM ARRANGEMENT FOR LIFTING A PIPE, AND A METHOD FOR OPERATING SAME LIFTING ARM ARRANGEMENT

(71) Applicant: MHWIRTH AS, Kristiansand (NO)

(72) Inventor: Per Morten Loevsland, Kristiansand (NO)

(73) Assignee: MHWIRTH AS, Kristiansand (NO)

( * ) Notice: Subject to any disclaimer, the term of this patent is extended or adjusted under 35 U.S.C. 154(b) by 0 days.

(21) Appl. No.: 15/030,599

(22) PCT Filed: Sep. 29, 2014

(86) PCT No.: PCT/EP2014/070737
§ 371 (c)(1),
(2) Date: Apr. 20, 2016

(87) PCT Pub. No.: WO2015/058926
PCT Pub. Date: Apr. 30, 2015

(65) Prior Publication Data

US 2016/0251915 A1 Sep. 1, 2016

(30) Foreign Application Priority Data

Oct. 22, 2013 (NO) ..... 20131395

(51) Int. Cl.
*E21B 19/00* (2006.01)
*E21B 19/14* (2006.01)
(Continued)

(52) U.S. Cl.
CPC ..... *E21B 19/14* (2013.01); *B66F 11/00* (2013.01); *E21B 19/087* (2013.01); *E21B 19/15* (2013.01)

(58) Field of Classification Search
CPC .... B66F 3/24; B66F 3/26; B66F 11/00; B66F 11/042; E21B 10/14; E21B 10/089
(Continued)

(56) References Cited

U.S. PATENT DOCUMENTS 2,871,743 A 2/1959 Kelley
3,120,312 A * 2/1964 Hudak ..... B65H 3/0816 271/13
(Continued)

FOREIGN PATENT DOCUMENTS

EP 0 199 664 A2 10/1986
EP 0 243 993 A1 11/1987
(Continued)

*Primary Examiner* — Mark Beauchaine
(74) *Attorney, Agent, or Firm* — Norman B. Thot

(57) ABSTRACT

A lifting arm arrangement includes a gripper head arm, a lifting arm, and a lifting cylinder. A gripper head is fastened to a first gripper head arm end. A first lifting arm end is pivotally connected to the gripper head arm. A second lifting arm end is pivotally connected to a stationary lifting cylinder part. A second gripper head arm end is pivotally connected to a movable lifting cylinder part. The stationary lifting cylinder part comprises a cylinder with a cylinder cavity having first and second cylinder openings. A piston rod with a piston is arranged in the cylinder cavity. A first piston rod portion projects from a first piston end of the piston. A second piston rod portion projects from an opposite second piston end of the piston. Working areas of the first and second piston ends are substantially equal to each other.

7 Claims, 8 Drawing Sheets

(51) Int. Cl.
*E21B 19/087* (2006.01)
*E21B 19/15* (2006.01)
*B66F 11/00* (2006.01)

(58) Field of Classification Search
USPC ..... 414/22.63, 22.54, 22.55, 22.56
See application file for complete search history.

(56) References Cited

U.S. PATENT DOCUMENTS

| | | | | |
|---|---|---|---|---|
| 4,081,084 | A | 3/1978 | Guinn et al. | |
| 4,345,864 | A | 8/1982 | Smith et al. | |
| 4,696,207 | A | 9/1987 | Boyadjieff | |
| 4,709,766 | A | 12/1987 | Boyadjieff | |
| 4,765,401 | A | 8/1988 | Boyadjieff | |
| 4,792,172 | A | 12/1988 | Montanari et al. | |
| 5,244,329 | A * | 9/1993 | McGill ..... | E21B 19/14 175/52 |
| 2004/0057815 | A1 | 3/2004 | Woolslayer et al. | |
| 2005/0061548 | A1 | 3/2005 | Hooper et al. | |
| 2006/0104747 | A1 | 5/2006 | Zahn et al. | |

FOREIGN PATENT DOCUMENTS

| | | | |
|---|---|---|---|
| GB | 1 204 864 | A | 9/1970 |
| JP | 11-101086 | A | 4/1999 |
| WO | WO 93/15303 | A1 | 8/1993 |

* cited by examiner

LIFTING ARM ARRANGEMENT FOR LIFTING A PIPE, AND A METHOD FOR OPERATING SAME LIFTING ARM ARRANGEMENT

CROSS REFERENCE TO PRIOR APPLICATIONS

This application is a U.S. National Phase application under 35 U.S.C. §371 of International Application No. PCT/EP2014/070737, filed on Sep. 29, 2014 and which claims benefit to Norwegian Patent Application No. 20131395, filed on Oct. 22, 2013. The International Application was published in English on Apr. 30, 2015 as WO 2015/058926 A2 under PCT Article 21(2).

FIELD

The present invention relates to a lifting arm arrangement for lifting a pipe, and a method for operating the lifting arm arrangement. The lifting arm arrangement comprises a gripper head arm with a gripper head fastened to a first end of the gripper head arm, and a lifting arm that has a first end pivotally connected to the gripper head arm. The present invention further comprises a lifting cylinder comprising a stationary part and a movable part. The second end of the lifting arm is pivotally connected to the stationary part of the lifting cylinder, and the second end of the gripper head arm is pivotally connected to the movable part of the lifting cylinder, or vice versa.

BACKGROUND

The use of different lifting arm arrangements for lifting a pipe has previously been described. The use of lifting cylinders to move the lifting arm arrangements has also previously been described.

Various documents describe systems for lifting pipes where a cylinder is used to carry out the lifting movement.

U.S. Pat. No. 4,765,401 describes a cylinder structure containing a piston having a throughgoing piston rod where a carriage carrying a torque wrench and a spinner is fastened to the piston rod. Movement of the piston in the cylinder structure results in horizontal movement of the carriage.

U.S. Pat. No. 4,081,084 describes a crane system for retrieving casings that are stored below deck. A carriage that travels along a track is used together with a hook system to move the casings. The hook elements move in and out of engagement with the ends of the casings using pistons that move in cylinders and thus move the carriages.

EP 0243993 and U.S. Pat. No. 2,871,743 describe pipe clamps and EP 0199664 describes a pipe handling machine equipped with carriages that are moved by the movement of a piston in a cylinder.

US 2006/104747, U.S. Pat. No. 4,696,207 and GB 1204864 describe background art of the present invention.

SUMMARY

An aspect of the present invention is to produce a flexible lifting arm arrangement that has a large extent and range when in the operative state, and which is relatively compact when in the folded state. A further aspect of the present invention is to produce a lifting arm arrangement that is stable throughout its range of motion.

In an embodiment, the present invention provides a lifting arm arrangement for lifting a pipe which includes a gripper head arm, a lifting arm, and a lifting cylinder. The gripper head arm comprises a first gripper head arm end, a second gripper arm end, and a gripper head which is fastened to the first gripper head arm end. The lifting arm comprises a first lifting arm end and a second lifting arm end. The first lifting arm end is pivotally connected to the gripper head arm. The lifting cylinder comprises a stationary lifting cylinder part and a movable lifting cylinder part. The second lifting arm end is pivotally connected to the stationary lifting cylinder part. The second gripper head arm end is pivotally connected to the movable lifting cylinder. The stationary lifting cylinder part comprises a cylinder which comprises a cylinder cavity with a first cylinder opening and a second cylinder opening. The movable lifting cylinder part comprises a piston rod with a piston arranged in the cylinder cavity. The piston is arranged to divide the cylinder cavity into a first cylinder chamber and a second cylinder chamber. The piston rod comprises a first piston rod portion and a second piston rod portion. The first piston rod portion is arranged to project from a first piston end of the piston. The second piston rod portion is arranged to project from a second piston end of the piston which is opposite to the first piston end. A first working area of the first piston end is substantially equal to a second working area of the second piston end.

BRIEF DESCRIPTION OF THE DRAWINGS

The present invention is described in greater detail below on the basis of embodiments and of the drawings in which.

DETAILED DESCRIPTION

Figure 1:
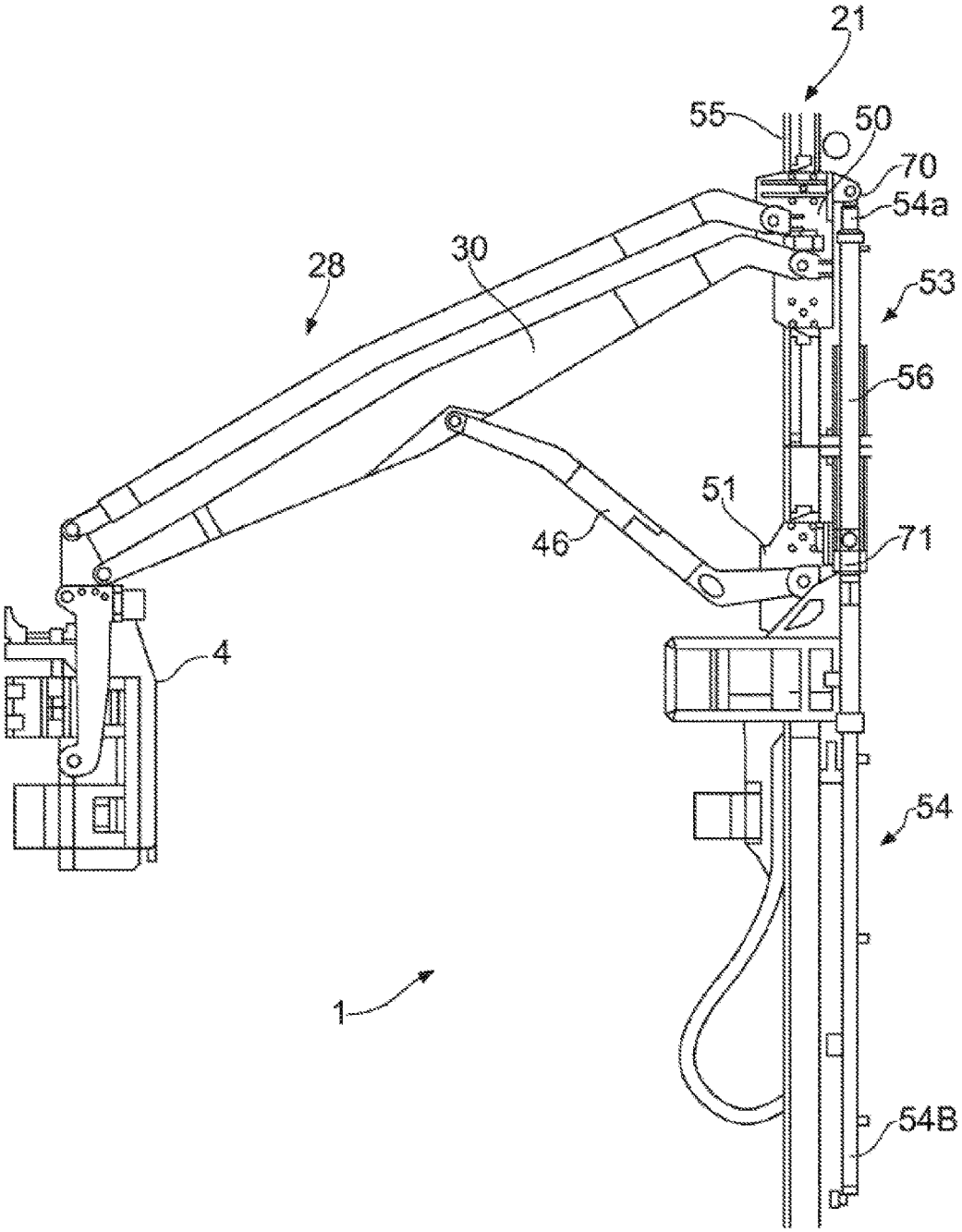
FIG. 1 shows a lifting arm arrangement in an extended position.

The lifting arm arrangement according to the present invention has a lifting cylinder, the stationary part of the lifting cylinder comprising a cylinder having a cylinder cavity, and the movable part of the lifting cylinder comprising a piston rod arranged in the cylinder cavity. The piston divides the cylinder cavity into a first and a second cylinder chamber. A first piston rod portion projects from a first side of the piston, and a second piston rod portion projects from a second opposite side of the piston so that the working area of the first side of the piston is essentially as large as the working area of the second side of the piston.

In an embodiment of the present invention, the lifting cylinder can, for example, be positioned vertically. This orientation of the lifting cylinder contributes to a compact design. When the lifting arm arrangement is mounted to a vertical column structure (vertical pipe racker, VPR), the lifting cylinder will be mounted in a vertical position that is parallel to the extent of the vertical pipe racker in the vertical direction.

The geometry of the lifting arm arrangement is such that the exchange between the movements of the gripper head and the movement of the lifting cylinder will change. In an inner position, the gripper head will move 10 times faster than the movement of the cylinder, while in an outer position, for example, when the arm arrangement is almost extended or is fully extended, the gripper head moves at a half speed relative to the cylinder movement. The design of the lifting arm arrangement therefore poses challenges with regard to stability and the consumption of fluid into and out of the lifting cylinder.

The buckling length of the piston rod is determining for dimensioning the lifting cylinder. At a given load, the piston rod will have a given diameter which in turn determines the cylinder diameter. By choosing an ordinary hydraulic cylinder with a relatively large difference in the volume on both sides of the cylinder piston, a correspondingly large difference in the amount of oil that must be supplied to and drawn off from the cylinder chambers in order to operate the cylinder is obtained. The relatively large amount of oil that must be supplied to the cylinder to achieve a certain minimum speed of movement of the piston determines the size of pipes, hoses, and control valves. A reduction of the amount of oil supplied will therefore have a beneficial effect on the system. The most important effect of the reduction in the amount of oil supplied is, however, that a good control of the movements of the gripper head arm is obtained.

The weight of valves, pipes, and hoses contribute to the overall weight of the system. It is therefore important that these components are designed to be fairly low in weight, either individually or in combination with each other.

The first and the second piston rod portion are of the same size, which causes the working area and thus the lifting area to be the same on both sides of the piston. The fluid quantity which must be supplied to one of the cylinder chambers and which flows out of the other cylinder chamber as the piston is moved is reduced compared with the fluid quantity that must be supplied to a cylinder where the piston area is different on the two sides of the piston. Better control is obtained of the movements of the lifting device since the amount of oil supplied can be reduced. A simplification of the structure of the lifting device is also achieved when fluid flowing out of and into the cylinder chambers is identical because valves having the same valve characteristics can be used in the two cylinder chambers.

Configuring the piston rod so that it has the same area on both sides of the piston allows the relative difference between the volumes on either side of the piston to be eliminated. This has positive effects on fluid consumption, which through this configuration of the piston rod can be reduced substantially, and in certain cases by more than 60%, compared with a piston rod configuration where there is a great difference between the size of the area on each side of the piston. This reduction of fluid consumption has significance for dimensioning the fluid-carrying valves and pipes that consequently can be dimensioned smaller. The pipes can in some cases have a length of up to 100 meters so that a reduction in the diameter of the pipes will have a weight-saving effect.

A lifting arm arrangement of the present invention, where a piston with a throughgoing piston rod arranged in a cylinder is used to move the lifting arm arrangement, has not previously been described.

In an embodiment of the present invention, the first and the second piston rod portion have a diameter that is essentially identical. Both piston rod portions extend from the piston and out through their respective cylinder opening in the cylinder. The first cylinder chamber can be configured with a first fluid aperture, and the second cylinder chamber can be configured with a second fluid aperture. Equally large amounts of fluid are supplied and drawn off through the first and second fluid apertures when the piston is moved in the cylinder cavity.

In an embodiment, the present invention also includes a method for operating a lifting arm arrangement, the method comprising supplying fluid to one of the cylinder chambers and drawing off fluid from the other cylinder chamber in order to move the piston in the cylinder cavity, and thus alter the position of the gripper head arm, and hence the position of the gripper head, inasmuch as the fluid volume that is supplied and drawn off from the two cylinder chambers is substantially the same.

An example of an embodiment of the present invention will be described below under reference to the drawings.

Figure 2:
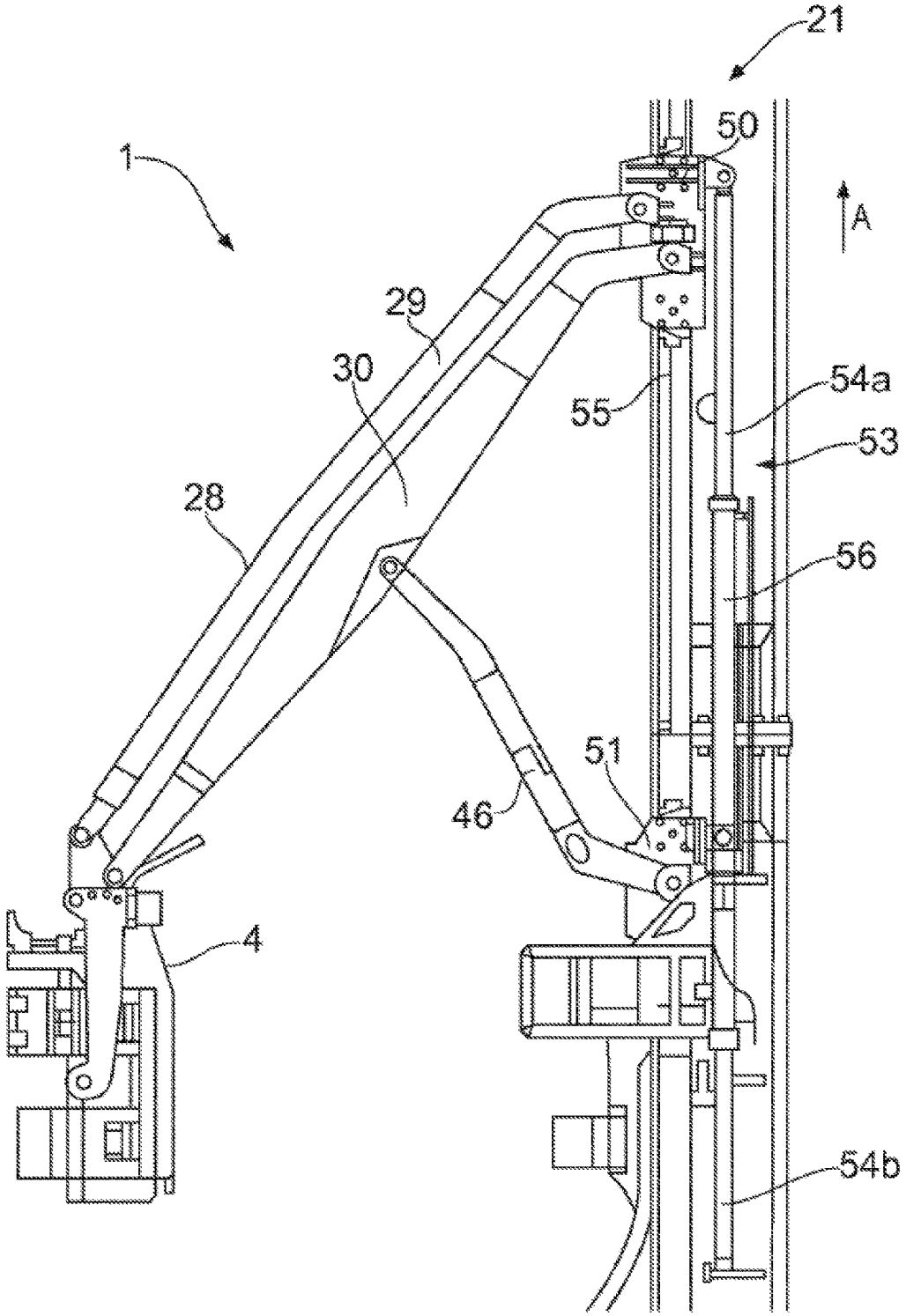
FIG. 2 shows a lifting arm arrangement in an intermediate position.
Figure 3:
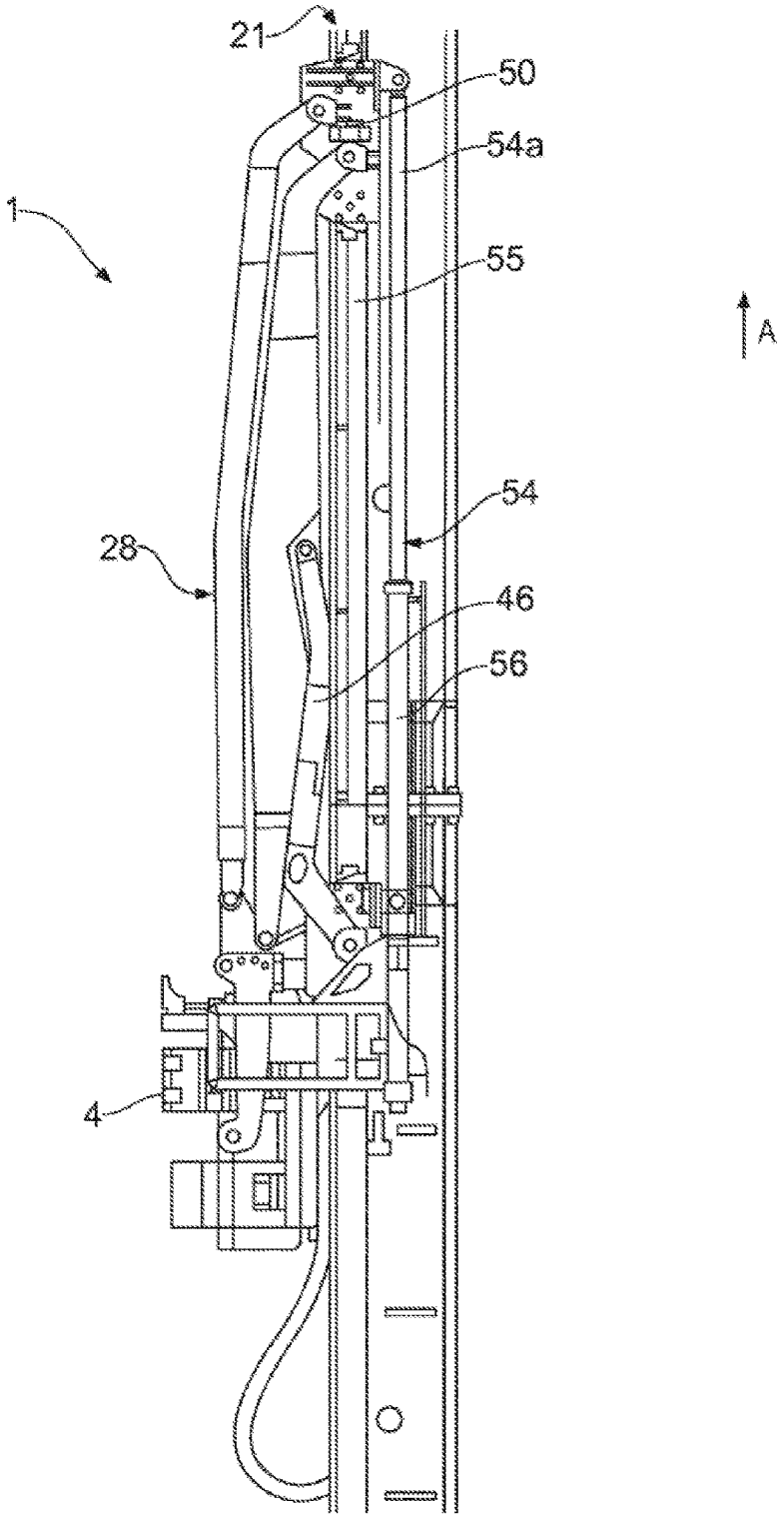
FIG. 3 shows the lifting arm arrangement in a folded position.

FIGS. 1-3 show a lifting arm arrangement 1 that is used to lift and move pipes between the well center and the storage area in the derrick. The lifting arm arrangement 1 may be one of a total of three arm arrangements, where the lifting arm arrangement 1 lifts, while the two other arm arrangements support the upper and lower part of the pipe. The geometry of the lifting arm arrangement 1 is selected in order to have maximum range, while it should be as compact as possible in folded position. The geometric configuration of the lifting arm arrangement 1 facilitates the space-efficient storage of pipes. The fingerboard can be extended closer to the lifting arm arrangement 1 because the arrangement is compact in a folded state, while having a long range in an extended state and thus reaching more pipes.

The lifting arm arrangement 1 comprises a gripper head 4 that is used when a pipe is to be lifted. The gripper head 4 is pivotally connected to an end of a gripper head arm 28, which in the shown embodiment comprises two parallel arms 29, 30. The other end of the gripper head arm 28 is pivotally fastened to an upper dolly 50. A lifting arm 46 is pivotally fastened to a lower dolly 51 at one end, and the other end of the lifting arm 46 is pivotally fastened to the gripper head arm 28. The upper dolly 50 can be moved relative to the lower dolly 51 via operation of a lifting cylinder 53, and through this movement the gripper head arm 28 and the lifting arm 46 are rotated inwards towards or outwards away from the lifting cylinder 53. In the embodiment that is shown in FIGS. 1-3, the lifting arrangement 1 is fastened to a vertical column structure 21 (vertical pipe racker). The upper dolly 50 can then be slidably attached to rails 55 on the vertical pipe racker 21 as is shown in FIG. 1. On operation of the lifting cylinder 53, which is also fastened to the vertical pipe racker 21, the upper dolly 50 travels along the rails 55 when moved to another position.

The lifting cylinder 53 comprises a piston rod 54 with a piston 57 and a cylinder 56, as is shown in FIGS. 4-7. The piston rod 54 has a fastening device 70 for attachment to the upper dolly 50, and the cylinder 56 is fastened to the lower dolly 51 by a fixing element 71. The piston rod 54 is arranged with the piston 57 so that the piston surface area on the two opposite sides of the piston 57 are essentially of equal size. The piston 57 divides the cylinder cavity into a first cylinder chamber 58*a* and a second cylinder chamber 58*a*. The piston rod 54 has a first piston rod portion 54*a* that projects from one of the end openings 56*a* of the cylinder 56, and a second piston rod portion 54*b* that projects from the other end opening 56*b* of the cylinder 56. FIGS. 4-7 show that the first piston rod portion 54*a* is constituted of a first separate part while the second piston rod portion 54*b* is constituted of a second separate part. The first separate part of the piston rod 54 is passed through an opening 57*a* in the piston 57 and fastened to the second separate part of the piston rod 54 by a screw connection 72.

The piston rod 54 and its attachment to the piston 57 can here be configured in different ways. The piston rod 54 can be made in one piece that is passed through the piston 57 and fastened thereto. The piston rod 54 can alternatively be divided into two parts, each of which is fastened to the piston 57 or fastened to each other in different ways.

FIGS. 4-7 show that the diameter of the piston rod is selected so that the piston rod 54 fills a substantial part of the first cylinder chamber 58*a* and the second cylinder chamber 58*b* on both sides of the piston 57. The diameter of the piston 57 and the diameter of the piston rod 54 essentially correspond to each other. This configuration of the piston 57, the piston rod 54, and the cylinder 56 results in the total volume of the first cylinder chamber 58*a* and the second cylinder chamber 58*b* having a fairly limited size. In the shown embodiment, the piston rod takes up 64% of the volume of the cylinder chambers 58*a*, 58*b*. With a piston rod of this size, the remaining piston area and thus the working area on which the oil acts, constitutes 36% of the cross-sectional area of the cylinder chambers.

The piston 57 and the piston rod 54 are moved in the cylinder cavity by the supply of fluid to one of the cylinder chambers and by drawing off of fluid from the other cylinder chamber through fluid apertures 61*a*, 61*b*. Owing to the size of the cylinder chambers 58*a*, 58*b* and the piston rod 54, the flow of fluid in and out of the cylinder chambers through the fluid apertures 61*a*, 61*b* to obtain movement of the piston 57 and the piston rod 54 is relatively limited.

Figure 4:
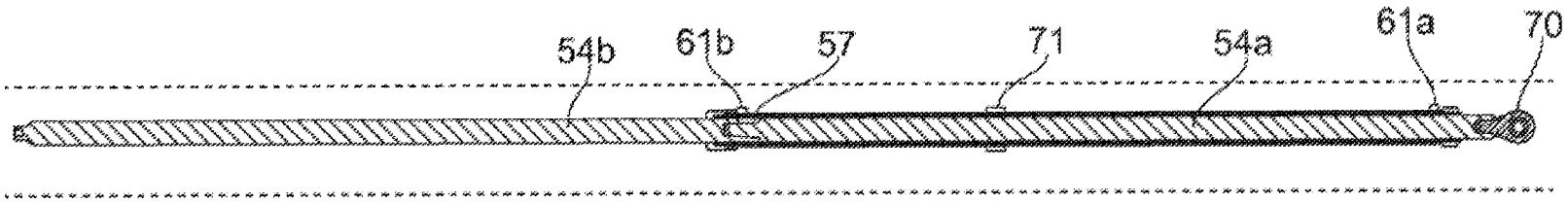
FIG. 4 shows a sectional view of a lifting cylinder when the lifting arm arrangement is positioned in the extended position as shown in FIG. 1.

FIG. 1 shows the lifting arm arrangement 1 in an extended position. The gripper head arm 28 with the gripper head 4 is then moved into a position in which the horizontal distance from the lifting cylinder 53 is the maximum. In this position, the piston rod 54 is shown in its lower position in the cylinder 56, and the upper dolly 50 is placed in a lower position. FIG. 4 shows that the piston 57 is then moved into a first (lower) end position in the cylinder 56, with a substantial part of the first piston rod portion 54*a* taken up in the cylinder cavity and a substantial part of the second piston rod portion 54*b* projecting from the cylinder 56.

From the end position shown in FIG. 4, the piston 57 and the piston rod 54 are moved in the cylinder cavity towards the second (upper) end position of the piston 57. Through this piston movement, an increasingly larger portion of the second piston rod portion 54*b* will then be taken up in the cylinder cavity, while an increasingly larger part of the first piston rod portion 54*a* will be moved out of the cylinder cavity to project from the cylinder 56.

Figure 5:
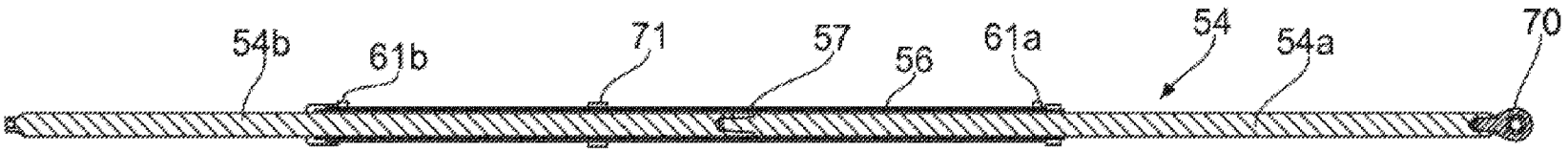
FIG. 5 shows a sectional view of the lifting cylinder when the lifting arm arrangement is in the intermediate position as shown in FIG. 2.
Figure 6:
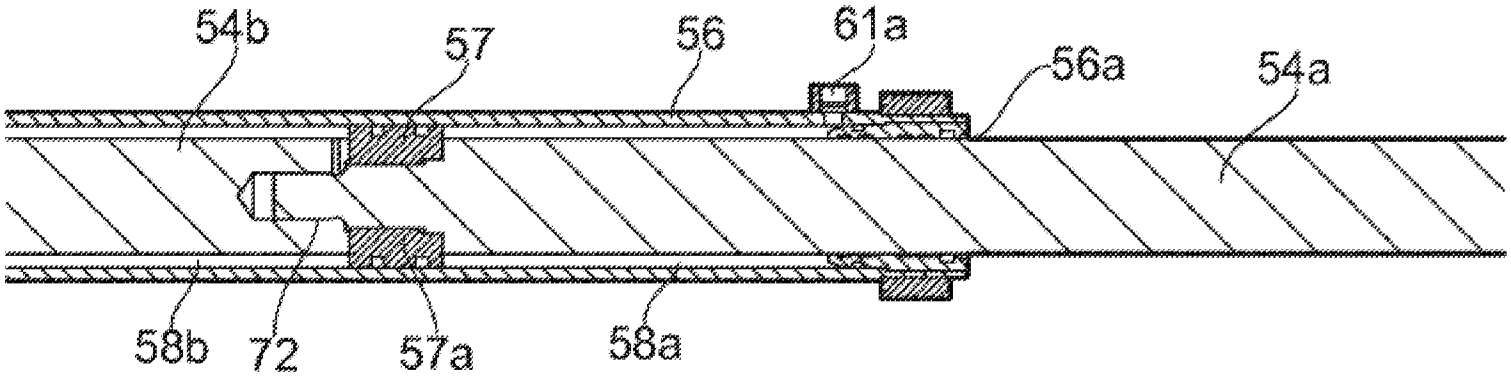
FIG. 6 shows an enlarged sectional view of a part of the lifting cylinder in FIG. 5.
Figure 7:
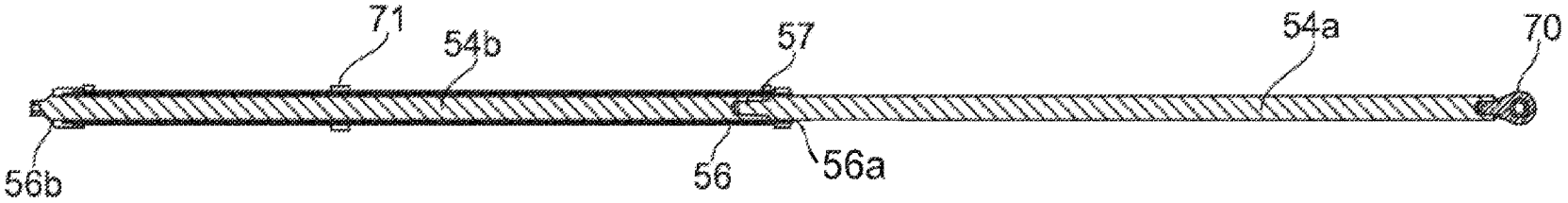
FIG. 7 shows a sectional view of a lifting cylinder when the lifting arm arrangement is in the folded position as shown in FIG. 3.
Figure 8:
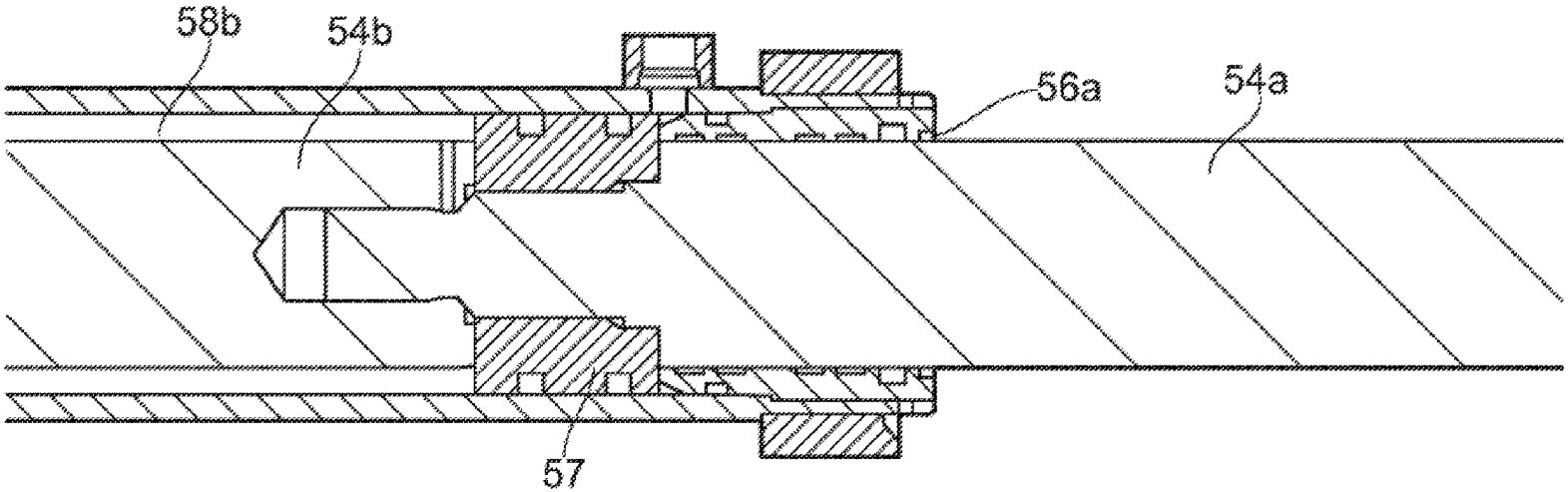
FIG. 8 shows an enlarged sectional view of a part of the lifting cylinder in FIG. 7.

FIGS. 5 and 6 show the piston 57 and the piston rod 54 in a position that places the lifting arm arrangement 1 in an intermediate position like that shown in FIG. 2, and in FIGS. 7 and 8, the piston 57 and the piston rod 54 being shown in an upper end position that places the lifting arm arrangement 1 in a folded position as is shown in FIG. 3.

On movement of the piston 57 and the piston rod 54 from the end position shown in FIG. 4, the piston rod 54 moves from the lower position shown in FIG. 1 and in a vertical upward direction as illustrated by the arrow A as shown in FIGS. 2 and 3, thereby also pushing the upper dolly 50 upwards. When the upper dolly 50 is moved upwards, the gripper head arm 28 and the lifting arm 46 are drawn in towards the lifting cylinder 53. As a result of this movement, the gripper head arm 28, with the gripper head 4, is then moved from an extended position as shown in FIG. 1 via an intermediate position as shown in FIG. 2 to a folded position as shown in FIG. 3.

The lifting cylinder 53 is placed in a vertical orientation to allow a compact embodiment of the present invention. The geometric configuration of the lifting arm arrangement 1 means that the transmission between the movement of the gripper head 4 holding the pipe to be lifted and the movement of the piston rod 54 in the cylinder 56 will change as the lifting arm arrangement 1 is moved from a folded to an extended position. In the folded position of the lifting arm arrangement 1 as shown in FIG. 3, the gripper head 4 moves ten times faster than the movement of the piston rod 54 in the cylinder 56. In the extended position of the lifting arm arrangement 1 as shown in FIG. 1, the gripper head 4 moves at only half speed in relation to the movement of the piston rod 54 in the cylinder 56. This poses challenges with regard to stability and flow consumption. By flow consumption is here meant the volume of fluid it is necessary to supply (and draw out) in order to move the piston rod 54 in the cylinder cavity.

Providing the lifting cylinder 53 with a throughgoing piston rod makes it possible to reduce flow consumption by more than 60%. When the lifting area is the same on both sides of the piston, as is the case with the lifting cylinder 53 according to the present invention, the fluid flow out of and into the cylinder chambers 58*a*, 58*b* through the fluid apertures 61*a*, 61*b* on each side of the piston 57 will be the same when the piston rod 54 with the piston 57 are moved in the cylinder cavity. This provides advantages in that both supply pipes and valves can be selected with a smaller dimension so that the total weight is lower. Because the lifting arrangement has the same lifting area, the lifting arrangement 1 can be operated manually in a simple manner by short-circuiting the cylinder chambers.

The present invention is not limited to embodiments described herein; reference should be had to the appended claims.

What is claimed is:

1. A lifting arm arrangement for lifting a pipe, the lifting arm arrangement comprising:

a gripper head arm comprising a first gripper head arm end, a second gripper arm end, and a gripper head which is fastened to the first gripper head arm end;

a lifting arm comprising a first lifting arm end and a second lifting arm end, the first lifting arm end being pivotally connected to the gripper head arm; and a lifting cylinder comprising a stationary lifting cylinder part and a movable lifting cylinder part, the second lifting arm end being pivotally connected to the stationary lifting cylinder part, and the second gripper head arm end being pivotally connected to the movable lifting cylinder, the stationary lifting cylinder part comprising a cylinder which comprises a cylinder cavity with a first cylinder opening and a second cylinder opening, and the movable lifting cylinder part comprising a piston rod with a piston arranged in the cylinder cavity, the piston being arranged to divide the cylinder cavity into a first cylinder chamber and a second cylinder chamber, the piston rod comprising a first piston rod portion and a second piston rod portion, the first piston rod portion being arranged to project from a first piston end of the piston, and the second piston rod portion being arranged to project from a second piston end of the piston which is opposite to the first piston end, a first working area of the first piston end being substantially equal to a second working area of the second piston end.

2. The lifting arm arrangement as recited in claim 1, wherein the lifting cylinder has a vertical orientation.

3. The lifting arm arrangement as recited in claim 1, wherein, the first piston rod portion comprises a first piston rod portion diameter, the second piston rod portion comprises a second piston rod portion diameter, and a size of the first piston rod portion diameter is substantially the same as a size of the second piston rod portion diameter.

4. The lifting arm arrangement as recited in claim 1, wherein, the first piston rod portion is arranged to extend from the piston in the first cylinder chamber out through the first cylinder opening in the cylinder, and the second piston rod portion is arranged to extend from the piston in the second cylinder chamber out through the second cylinder opening in the cylinder.

5. The lifting arm arrangement as recited in claim 4, wherein, the first cylinder chamber comprises a first fluid aperture, the second cylinder chamber comprises a second fluid aperture, and an equal fluid volume is supplied and/or drawn off via the first fluid aperture and the second fluid aperture when the piston is moved in the cylinder cavity.

6. A method for operating a lifting arm arrangement for lifting a pipe, the lifting arm arrangement comprising:

a gripper head arm comprising a first gripper head arm end, a second gripper arm end, and a gripper head which is fastened to the first gripper head arm end;

a lifting arm comprising a first lifting arm end and a second lifting arm end, the first lifting arm end being pivotally connected to the gripper head arm; and a lifting cylinder comprising a stationary lifting cylinder part and a movable lifting cylinder part, the second lifting arm end being pivotally connected to the stationary lifting cylinder part, and the second gripper head arm end being pivotally connected to the movable lifting cylinder, the stationary lifting cylinder part comprising a cylinder which comprises a cylinder cavity with a first cylinder opening and a second cylinder opening, and the movable lifting cylinder part comprising a piston rod with a piston arranged in the cylinder cavity, the piston being arranged to divide the cylinder cavity into a first cylinder chamber and a second cylinder chamber, the piston rod comprising a first piston rod portion and a second piston rod portion, the method comprising:

supplying a fluid to the first cylinder chamber and drawing off fluid from the second cylinder chamber or supplying the fluid to the second cylinder chamber and drawing off the fluid from the first cylinder chamber to move the piston and the piston rod in the cylinder cavity to alter a position of the gripper head arm and the thereby a position of the gripper head, wherein, a volume of the fluid supplied and drawn off is substantially the same.

7. A lifting arm arrangement for lifting a pipe, the lifting arm arrangement comprising:

a gripper head arm comprising a first gripper head arm end, a second gripper arm end, and a gripper head which is fastened to the first gripper head arm end;

a lifting arm comprising a first lifting arm end and a second lifting arm end, the first lifting arm end being pivotally connected to the gripper head arm; and a lifting cylinder comprising a stationary lifting cylinder part and a movable lifting cylinder part, the second lifting arm end being pivotally connected to the stationary lifting cylinder part, and the second gripper head arm end being pivotally connected to the movable lifting cylinder, the stationary lifting cylinder part comprising a cylinder which comprises a cylinder cavity with a first cylinder opening and a second cylinder opening, and the movable lifting cylinder part comprising a piston rod with a piston arranged in the cylinder cavity, the piston being arranged to divide the cylinder cavity into a first cylinder chamber and a second cylinder chamber, the piston rod comprising a first piston rod portion and a second piston rod portion, the first piston rod portion being arranged to project from a first piston end of the piston, and the second piston rod portion being arranged to project from a second piston end of the piston which is opposite to the first piston end, the first piston rod portion and the second piston rod portion being connected to each other by a screw connection, a first working area of the first piston end being substantially equal to a second working area of the second piston end.

* * * * *